US006502566B1

(12) United States Patent
Achkar

(10) Patent No.: US 6,502,566 B1
(45) Date of Patent: Jan. 7, 2003

(54) OVERHEAD ARROW SUPPORT DEVICE

(76) Inventor: Nibal Achkar, Box 1420, Biggar, Saskatchewan (CA), S0K 0M0

( * ) Notice: Subject to any disclaimer, the term of this patent is extended or adjusted under 35 U.S.C. 154(b) by 0 days.

(21) Appl. No.: 09/983,161

(22) Filed: Oct. 23, 2001

(51) Int. Cl.[7] ..... F41B 5/22
(52) U.S. Cl. ..... 124/44.5
(58) Field of Search ..... 124/24.1, 44.5

(56) References Cited

U.S. PATENT DOCUMENTS

| | | | | |
|---|---|---|---|---|
| 2,691,974 A | | 10/1954 | Nelson | |
| 3,153,406 A | | 10/1964 | Pemble | |
| 4,054,119 A | | 10/1977 | Hansen | |
| 4,372,282 A | | 2/1983 | Sanders | |
| 4,473,058 A | | 9/1984 | Terry | |
| 4,858,589 A | | 8/1989 | Chang | |
| 4,917,072 A | | 4/1990 | Chang | |
| 4,949,699 A | * | 8/1990 | Gerber | 124/44.5 |
| 5,632,263 A | * | 5/1997 | Sartain | 124/44.5 |
| 5,676,121 A | | 10/1997 | Bizier | 124/44.5 |
| 5,678,530 A | * | 10/1997 | VanDrielen | 124/44.5 |
| 6,089,216 A | * | 7/2000 | Harwath et al. | 124/44.5 |
| 6,276,352 B1 | * | 8/2001 | Harris et al. | 124/44.5 |

FOREIGN PATENT DOCUMENTS

| | | |
|---|---|---|
| CA | 2039979 | 4/1991 |
| CA | 2141644 | 2/1995 |
| CA | 2209168 | 8/1997 |
| CA | 2212594 | 8/1997 |

* cited by examiner

*Primary Examiner*—John A. Ricci
(74) *Attorney, Agent, or Firm*—Ridout & Maybee LLP

(57) ABSTRACT

A support device for attachment to a bow for holding an arrow in position with respect to the bow string. The support device comprising a support frame comprising a pair of arms, which with respect to the bow when in operation, are downwardly and forwardly extending to terminate in lower cradle tips. These are spaced apart and positioned so as to support an arrow shaft in perpendicular orientation to the bow string of an archery bow to which the device is attached and to permit unobstructed fletch clearance during launch of the arrow. Thus, said arms also having top ends which are integrally connected to each other by a bridging member, whereby the arms and bridging member circumscribe the arrow to be launched from the archery bow. An attachment means for releasably securing the support device to the handle region of an archery bow and a means connecting the support frame to the attachment means at a location above the lower ends of the arms.

8 Claims, 3 Drawing Sheets

OVERHEAD ARROW SUPPORT DEVICE

FIELD OF THE INVENTION

The present invention relates to a device for supporting an arrow on an archery bow prior to launch.

BACKGROUND OF THE INVENTION

A wide variety of devices for supporting an arrow on an archery bow are already known in the art. However, many of these devices are unsatisfactory, in that they support the arrow only from an underneath position. This allows the arrow to easily fall off the bow when the bow is not held in a strictly vertical position or during windy conditions. This can create difficulties for the archer as the arrow must then be relocated back onto the rest before launching can occur. Furthermore, it can be very dangerous to the archer and others in the area and sometimes result in personal injuries or damage to equipment. An example of such a device is disclosed in U.S. Pat. No. 5,676, 121 to Bizier, which teaches a forked arrow rest that is positioned underneath the shaft of an arrow.

Other devices have attempted to overcome these difficulties by providing an arrow support which completely or partially surrounds the arrow in order to prevent it from falling off the support. An example of such a device is taught in U.S. Pat. No. 4,917,072 to Chang, which discloses a conical frame with a central arrow support aperture including radiating slots to permit passage of the feathers therethrough. Although the support rests taught in Chang and similar devices have been somewhat successful in ensuring that the arrow remains on the support, such devices are still unsatisfactory, in that many of them are unable to provide unobstructed fletching clearance. This is very undesirable from an archer's perspective, as when the fletching on the arrow comes into contact with the components of a support device, it will result in decreased speed and accuracy. Moreover, increased contact will also cause considerable wear on the fetching over time, resulting in fletchings and arrows having to be replaced more frequently.

Other references of general background interest, relating to various constructions of arrow supports include:

| Patent Application No. | Filed | Laid Open | Issued |
|---|---|---|---|
| Canadian Laid Open Application No. 2,209,168 | Aug. 4, 1997 | Feb. 4, 1999 | — |
| Canadian Laid Open Application No. 2,039,979 | April 8, 1991 | Dec. 15, 1991 | Jan. 7, 1997 |
| Canadian Laid Open Application No. 2,212,594 | Aug. 6, 1997 | Feb. 8, 1998 | — |
| Canadian Laid Open Application No. 2,141,644 | Feb. 1, 1995 | Aug. 2, 1996 | Nov. 9, 1999 |
| U.S. Pat. No. 2,691,974 | May 20, 1952 | — | Oct. 19, 1954 |
| U.S. Pat. No. 3,153,406 | July 11, 1961 | — | Oct. 20, 1964 |
| U.S. Pat. No. 4,054,119 | Jan. 26, 1976 | — | Oct. 18, 1977 |

-continued

| Patent Application No. | Filed | Laid Open | Issued |
|---|---|---|---|
| U.S. Pat. No. 4,473,058 | Sept. 30, 1982 | — | Sept. 25, 1984 |
| U.S. Pat. No. 4,858,589 | July 11, 1988 | — | Aug. 22, 1989 |
| U.S. Pat. No. 4,917,072 | Jan. 12, 1989 | — | April 17, 1990 |
| U.S. Pat. No. 4,372,282 | Feb. 8, 1980 | — | Feb. 8, 1983 |

SUMMARY OF THE INVENTION

Accordingly, it is an object of the present invention to provide an improved arrow support device which will eliminate the likelihood of an arrow shifting or falling out of position. It is a further object of the present invention to provide an arrow support which will allow for unobstructed and complete fletching clearance, there by reducing wear on the fletching and ensuring that no loss in speed or accuracy occurs during the launching of the arrow. It is also an object of the present invention to provide an arrow support device which can be used with any sized three vaned arrow and be attached to bows designed for both left and right-handed archers.

These objectives are accomplished by providing a support device for attachment to a bow which device holds an arrow in position with respect to a bow string. The device has a support frame generally composed of a pair of arms, which when in operation, are downwardly and forwardly extending and terminate in lower ends that are spaced apart and positioned so as to support the arrow shaft in perpendicular orientation to the bow string of the archery bow to which the device is attached. This structure allows for unobstructed passage of the fletching of the arrow. The support arms are integrally connected to each other at their top ends by a bridging member, so that in combination, the arms and bridging member circumscribe the arrow to be launched from the archery bow, thereby minimizing any possibility of the arrow falling off the bow. The support device also includes an attachment means for releasably securing the support device to the handle region of the archery bow, as well as a means for connecting the support frame to the attachment means at a location above the lower ends of the arms.

Several different embodiments of the support device are provided so that the device can be used in conjunction with both a mechanical and finger release mechanism on a bow, and so that fetching clearance, positions and loads can be varied. The device can be mounted rigidly or can incorporate a spring loaded mechanism which will assist in absorbing pressure loads created by launching, either by fingers or with the aid of a release mechanism.

The arrow support device according to the present invention is effective in holding an arrow in ready-to-launch position with respect to the bow string. Its construction minimizes contact with the arrow fletching, during use, and hence reduces wear on the fletching.

BRIEF DESCRIPTION OF THE DRAWINGS

These and other advantages of the invention will become apparent upon reading the following detailed description and upon referring to the drawings in which.

Figure 1:
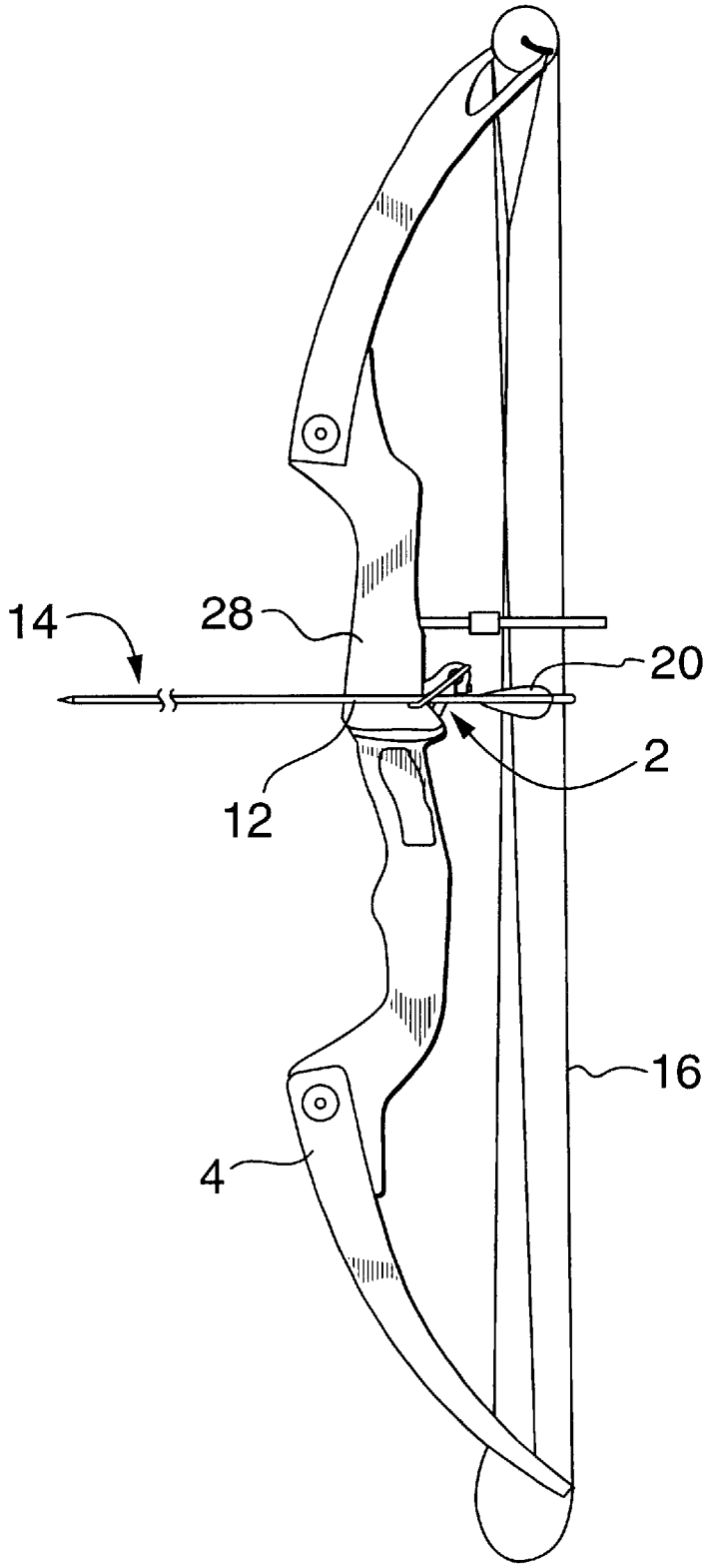
FIG. 1 is a side view of an archery bow to which is secured an arrow support device according to the present invention.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

Figure 2:
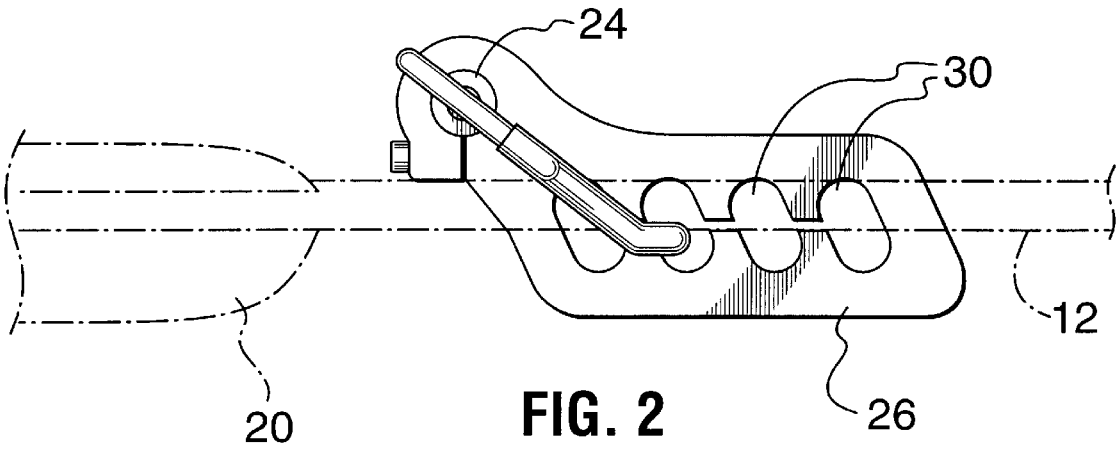
FIG. 2 is a side view of the arrow support device of FIG. 1.
Figure 3:
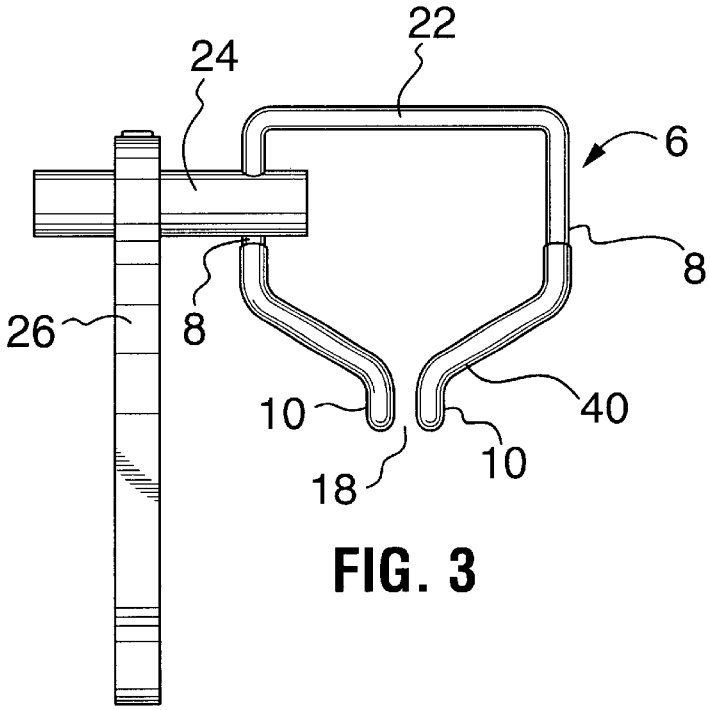
FIG. 3 is a top plan view of the arrow support device of FIGS. 1 and 2.
Figure 4:
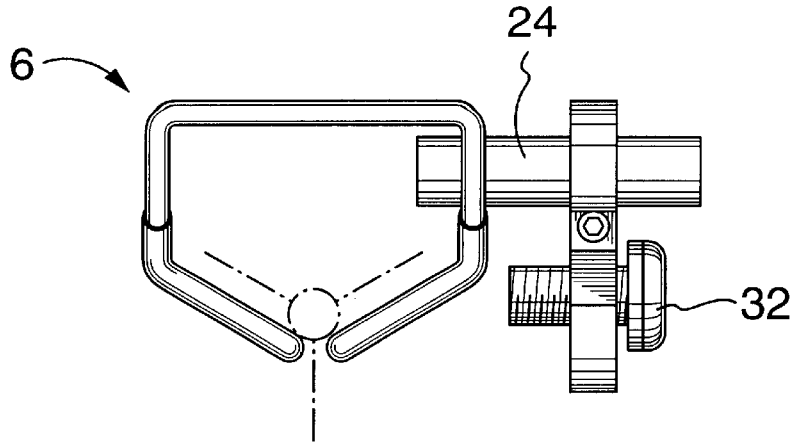
FIG. 4 is a rear elevational view of the device of FIGS. 1 and 2.

Turning to FIGS. 1–3, there is illustrated an arrow support device (2), intended for a manual arrow release setup, attached to a bow (4). Support device (2) comprise a support frame (6) having a pair of arms (8) downwardly and forwardly extending, with respect to the bow, and terminating in a pair of parallel-oriented lower ends or cradle tips (10). These tips (10) are spaced apart and positioned so as to support the shaft (12) of an arrow (14) in perpendicular relationship to string (16) of bow (4). The space (18) between tips (10) is sufficient to allow unobstructed passage of fletching (20) of arrow (14) as it is launched. Arms (8) are integrally joined at the other end by a bridge member (22) as illustrated.

This construction of frame (6), with bridging member (22) and arms (8) circumscribing shaft (12) of arrow (14), when it is resting in position on tips (18) prior to launch, makes it impossible for an arrow (14) to become dislodged by wind, movement of the archer, or the like. It makes it easier to launch the arrow from bow(4) and string (6).

Frame (6) is secured at bridging member (18) to a bar (24) which in turn is secured to a clamp (26) for releasable attachment to a bow handle (28). Frame (6), in this manner, is suspended from above by bar (24) to support arrow shaft (12), from below. Bar (24) is preferably pivotally attached to clamp (26) for attachment to bow (4) in proper position to permit its use by either left or right handed persons.

Clamp (26) is conventional, with a plurality of bow receiving apertures (30), for proper lateral position of frame (6) beside bow (4). A suitable bolt mechanism (32), or other releasable clamping device, cooperates with clamp (26) to releasably secure it to bow (4).

Figure 5:
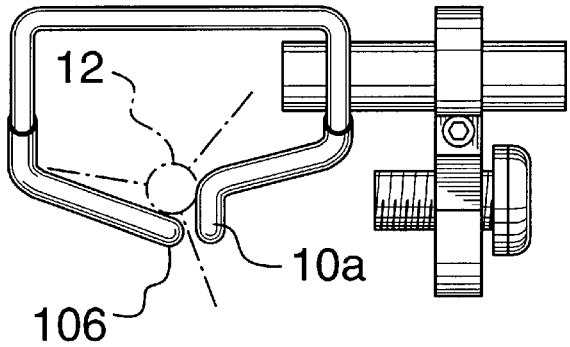
FIG. 5 is a rear elevational view of an alternative embodiment of the arrow support device.

In the alternative embodiment of FIG. 5, intended for a finger release, a support device (2) is illustrated which is similar to that of FIGS. 1 to 4 except with respect to the arrangement in orientation of tips (10). In this case, while tips (10) remain spaced apart sufficiently to allow unimpeded passage of a fletching (20) of arrow (14), and yet spaced close enough to allow shaft (12) to be supported on tips (10) prior to launch, they are not parallel to each other as in the case of the previous embodiment. In this case, one tip **(10*a*) is angled, as illustrated, downwardly forwardly, towards and below the other tip (10*b*). This tip orientation provides a larger pressure contact surface to absorb the significant side load that is exerted on the arm when shooting with fingers instead of a release mechanism. By contrast, the tip orientation shown in FIG. 4** is more appropriate when shooting with a release mechanism, as there is a slight down load on the arms.

Figure 6:
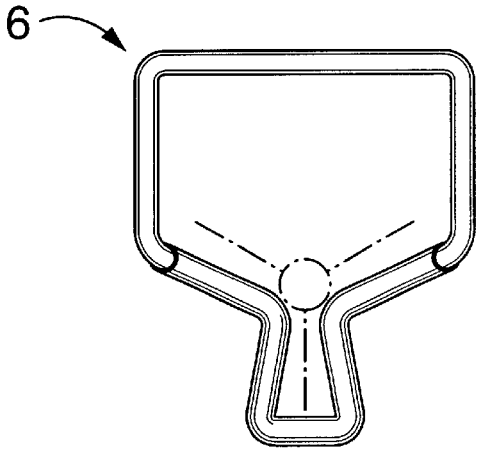
FIG. 6 is a schematic rear elevational view of the support frame of a further embodiment of the arrow support device according to the present invention.
Figure 7:
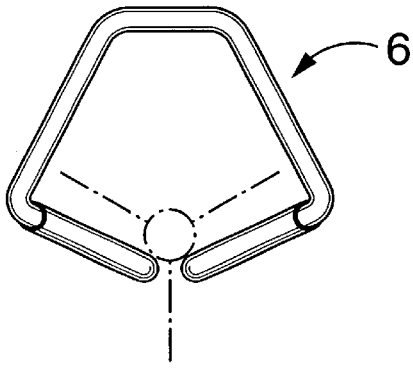
FIG. 7 is a schematic rear elevational view of the support frame of a further embodiment of the arrow support device according to the present invention.

In the embodiments of FIGS. 6 and 7, other shapes of frame (6) are illustrated which will provide many of the same benefits of the embodiments of FIGS. 1 to 3 and FIGS. 4 and 5.

It is preferred that tips (10) be coated with a Teflon™ sleeve or covering of some other rigid material (40), as illustrated, to minimize friction between the arrow shaft (12) and arms (8) during the launching of the arrow.

The construction of overhead arrow support device (2) according to the present invention provides a tension load, during launch of an arrow, which is greater than the conventional compression load found on other types of prior art arrow support systems. In fact, operating on a tension load provides almost double the strength of a compression load. Therefore, the rest can be constructed out of lighter material. More specifically, when the arrow is fired using a release mechanism there is a download on the contact area (the cradle arms) of the arrow rest. In addition, the cradling of shaft (12) of arrow (14) on tips (10) enables greater surface area contact with that shaft (12), as compared to many of the prior art devices previously described herein, thereby minimizing the amount of wear on tips (10) and shaft (12), over continued use. This construction of support also enhances an archer's accuracy. It is believed that this is due to the downwardly extended cradle arms re-aligning the arrow during the release process to correct any misalignment caused by bow hand torque (bow hand torque is caused by the twisting action of the bow arm or hand during the drawing sequence).

Thus, it is apparent that there has been provided in accordance with the invention an overhead arrow support system that fully satisfies the objects, aims and advantages set forth above. While the invention has been described in conjunction with illustrated embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A support device for attachment to a bow for holding an arrow in position with respect to the bow string, the support device comprising:

(a) a support frame comprising a pair of arms, which with respect to the bow when in operation, are downwardly and forwardly extending to terminate in lower cradle tips which are spaced apart and positioned so as to support an arrow shaft in perpendicular orientation to the bow string of an archery bow to which the device is attached and to permit unobstructed fletch clearance during launch of the arrow, said arms also having top ends which are integrally connected to each other by a bridging member, whereby the arms and bridging member circumscribe the arrow to be launched from the archery bow;

(b) an attachment means for releasably securing the support device to the handle region of an archery bow; and (c) a means connecting the support frame to the attachment means at a location above the lower ends of the arms.

2. A device according to claim 1, wherein the spaced apart cradle tips lower ends extend forwardly in parallel orientation to one another.

3. A device according to claim 1, wherein the cradle tips are oriented so as to support the arrow shaft, when in position for launch, from the sides and from below.

4. A device according to claim 1, wherein the attachment means comprises a body having a bow receiving aperture and a clamp for releasably securing attachment means to the bow when in said aperture in a manner such that the support frame is suspended from an overhead position with respect to the arrow.

5. A device according to claim 4, wherein the clamp is adjustably securable to the bow handle by means of a plurality of spaced apertures.

6. A device according to claim 1, wherein a bar pivotally connects the support frame to the attachment means.

7. A device according to claim 1, wherein the support frame is formed of rigid material.

8. A device according to claim 1, wherein the cradle tips are coated with a suitable material to reduce the noise and friction between the arrow and the device during launch.

* * * * *